US008567038B2

(12) United States Patent
Yan et al.

(10) Patent No.: US 8,567,038 B2
(45) Date of Patent: Oct. 29, 2013

(54) APPARATUS AND METHOD FOR TRANSPORTING VERTICAL AXIS WIND TURBINE

(75) Inventors: Qiang Yan, Shanghai (CN); Yihui Shen, Shanghai (CN); Dong Zhang, Shanghai (CN); Chaoqi Jiang, Shanghai (CN); Haifeng Niu, Shanghai (CN)

(73) Assignee: Qiang Yan, Shanghai (CN)

( * ) Notice: Subject to any disclaimer, the term of this patent is extended or adjusted under 35 U.S.C. 154(b) by 231 days.

(21) Appl. No.: 13/163,777

(22) Filed: Jun. 20, 2011

(65) Prior Publication Data

US 2011/0239460 A1 Oct. 6, 2011

Related U.S. Application Data

(63) Continuation of application No. PCT/CN2009/001440, filed on Dec. 14, 2009.

(30) Foreign Application Priority Data

Dec. 19, 2008 (CN) ..... 2008 1 0190619

(51) Int. Cl.
*B23Q 7/00* (2006.01)

(52) U.S. Cl.
USPC ..... 29/559; 29/525.11; 410/31

(58) Field of Classification Search
USPC ..... 29/559, 428, 469, 525.01, 525.02, 29/525.11, 822–824; 410/2, 44, 47, 410/31–42; 414/373, 397, 402; 206/446, 206/449
See application file for complete search history.

(56) References Cited

U.S. PATENT DOCUMENTS 6,983,844 B2 * 1/2006 O'Kane et al. ..... 206/443
2005/0123382 A1 * 6/2005 Christensen et al. ..... 414/373

FOREIGN PATENT DOCUMENTS

CN 1916397 A 2/2007
CN 101062728 A 10/2007

* cited by examiner

*Primary Examiner* — David Bryant
*Assistant Examiner* — Ryan J Walters
(74) *Attorney, Agent, or Firm* — Manni Li; Mei & Mark LLP

(57) ABSTRACT

The invention relates to a vertical axis wind turbine, and in particular to an apparatus and method for transporting the vertical axis wind turbine. The method for transporting the vertical axis wind turbine, including the steps of: employing an apparatus to be a box or frame; situating a generator horizontally in the apparatus; fixing an upper flange and lower flange to a vertical shaft; fixing the base of the generator on the corresponding surface of the apparatus through holes at the base of the generator; and supporting the other end of the vertical shaft by a supporting object.

9 Claims, 4 Drawing Sheets

APPARATUS AND METHOD FOR TRANSPORTING VERTICAL AXIS WIND TURBINE

CROSS-REFERENCE TO RELATED APPLICATIONS

This application is a continuation of International Patent Application No. PCT/CN2009/001440, with an international filing date of Dec. 14, 2009, designating the United States, now pending, and further claims priority benefits to Chinese Patent Application No. 200810190619.8, filed Dec. 19, 2008. The contents of all of the aforementioned applications, including any intervening amendments thereto, are incorporated herein by reference.

BACKGROUND OF THE INVENTION

1. Field of the Invention

This invention relates to a vertical axis wind turbine, and in particular to an apparatus and method for transporting the vertical axis wind turbine.

2. Description of the Related Art

As shown in FIG. 1, current vertical axis wind turbines comprise: a generator 2, and a wind mill 1 which consists of a vertical shaft 11, upper and lower flanges 15, supporting arms 12, and blades 13. Most of the parts mentioned above are delivered separately, and assembled and commissioned on-site. However, constrained by on-site conditions, tolerance in the assembly of the parts is loose, greatly undermining the wind turbine's stability, reliability, and service life. For example, the generator 2 and vertical shaft 11, two core parts which require great precision in assembly, are usually delivered separately. The quality of the assembly affects the wind turbine's stability, reliability, and service life. What's more, parts of wind turbines are usually heavy in weight, and damage may occur during transportation. When the parts are big, the assembly is difficult and more workload is needed.

SUMMARY OF THE INVENTION

The object of this invention is to overcome the above drawbacks by providing an apparatus and method for transporting vertical axis wind turbines which facilitates transporting and on-site assembly, as well as cuts workload and cost, and to prompt application of vertical axis wind turbines.

An apparatus is a box or a frame, for transporting the vertical axis wind turbine, wherein the undersurface of the box or the base of the frame has a plurality of connecting parts 22 designed to connect with the base of the generator 21.

The connecting parts in the box or the frame are designed to be connected with the holes 23 in the base of the generator.

The connecting parts in the box or the frame are designed to be connected with the standard holes 23 in the base of the generator.

The connections are done by bolting.

The width of one side of the box or the frame is slightly narrower or wider than that of the other side, and in the parts where two boxes or frames stacked, there are plurality holes for bolts to fix the upper and lower boxes or frames.

A method for transporting the vertical axis wind turbine comprising: employing an apparatus to be a box or frame; situating a generator horizontally in the apparatus; fixing an upper flange and lower flange to a vertical shaft; fixing the base of the generator on the corresponding surface of the apparatus through holes at the base of the generator; and supporting the other end of the vertical shaft by supporting object.

There is a supporting object in the apparatus for the vertical shaft 11, and the object may be made of steel, such as steel tape attached to the four pillars of the apparatus, or the object may be of rope or cord attached to the four pillars of the apparatus.

The width of one side of the apparatus is slightly narrower or wider than that of the other side, and in the parts where two boxes or frames stacked, there are plurality holes for bolts to fix the upper and lower apparatus, therefore a plurality of the apparatus can be stacked for transportation.

To avoid assembly the flanges on-site and reduce on-site workload, the upper flange and lower flange 15 are fixed to the vertical shaft 11 before transportation.

By employing the apparatus, on-site assembly workload and time are reduced by half compared with the prior practice of separately delivery and on-site assembly. Furthermore, the wind turbine's service life has been extended, because of increased reliability and stability, less shaking and resonance under high wind conditions, as well as reduced damage to coating on the wind turbine by on-site assembly.

BRIEF DESCRIPTION OF THE DRAWINGS

A detailed description of accompanying drawings will be provided below.

REFERENCE CHARACTERS

1—wind mill; 11—vertical shaft; 12—supporting arm; 13—blade; 15—upper flange and lower flange; 2—generator; 21—base of generator; 22—connecting parts; 23—holes; standard holes; 3—supporting object; 4—box or frame; 5—holes; and 6—bolts.

DETAILED DESCRIPTION OF THE EMBODIMENTS

Detailed description will be given below in conjunction with accompanying drawings.

Example 1

Figure 1:
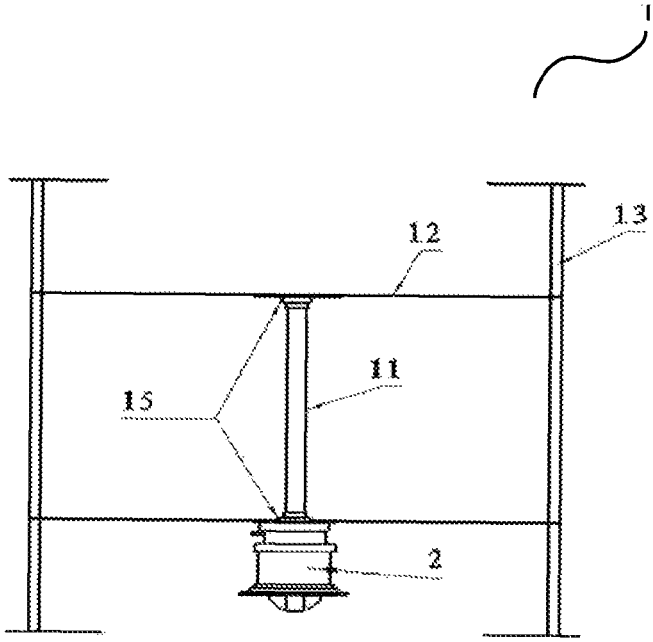
FIG. 1 is a schematic diagram of the current vertical axis wind turbine.
Figure 2:
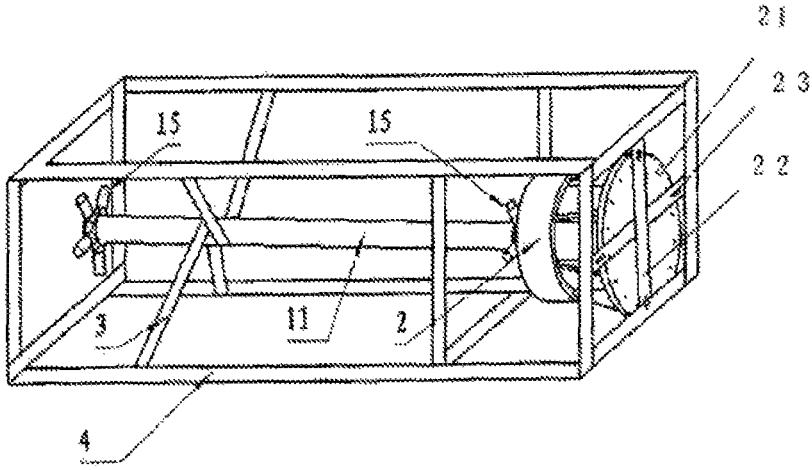
FIG. 2 is a schematic diagram of the present transporting apparatus.

As shown in FIG. 2, a schematic diagram of the present transporting apparatus, the apparatus is of a frame type. Put the generator horizontally in the frame 4, which can be a rectangular cuboid steel frame. The base of the frame has a plurality of connecting parts 22 designed to connect with the base of the generator 21. The standard holes 23 in the base of the generator are used to connect to the base of the frame by bolting. Alternatively, holes 23 may be drilled in the base of the generator and the base of the frame, and use bolts for connection.

Figure 3:
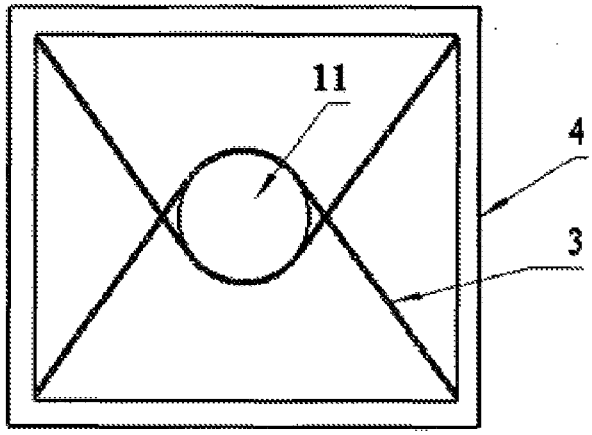
FIG. 3 is a schematic diagram of fastening of the vertical shaft of the vertical axis wind turbine.

As shown in FIG. 3, a schematic diagram of fastening of the vertical shaft, using a supporting object in the steel frame to support one end of the vertical shaft 11. The supporting object may be of steel tape or rope or cord, and is attached to the four pillars of the frame. The supporting object may be located at ⅓ of the vertical shaft.

To avoid assembly the flanges on-site and reduce on-site workload, the upper flange and lower flange 15 may be fixed to the vertical shaft 11 before transportation. In this way, the defect of loose tolerance for on-site flange-and-shaft assembly is solved, improving the wind turbine's stability and cutting on-site assembly time.

Figure 4:
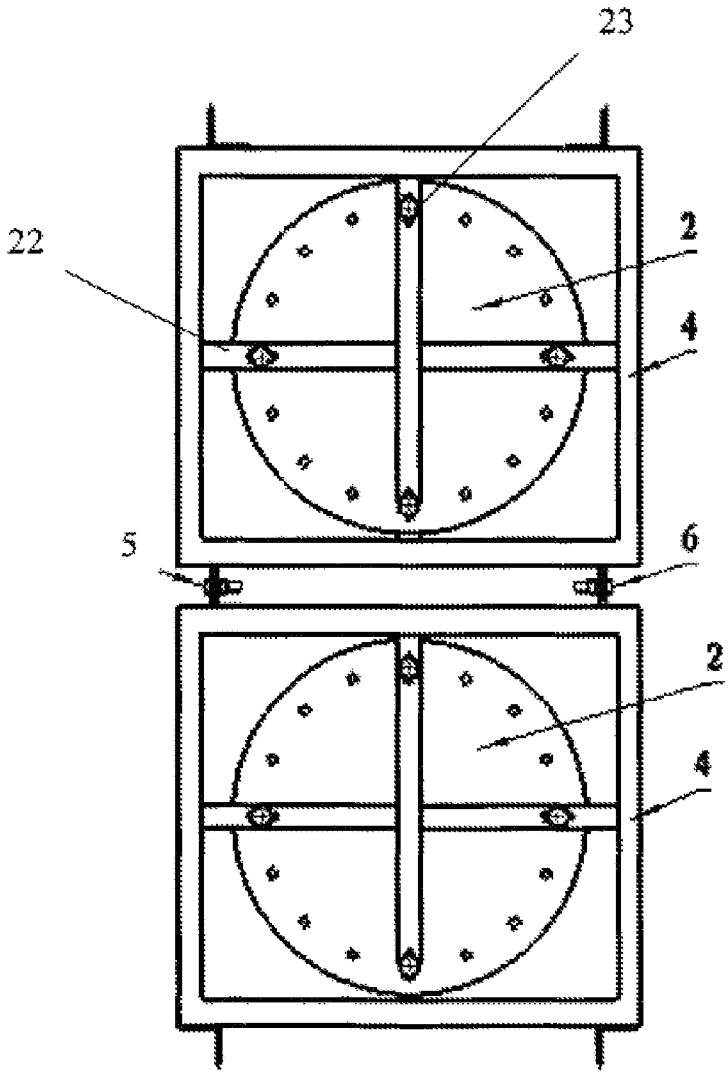
FIG. 4 is a schematic diagram of method for stacking the apparatus.

As shown in FIG. 4, to further facilitate the transportation, the width of one side of the frame is slightly narrower or wider than that of the other side. A plurality of holes 5 are drilled at the connecting parts when frames are stacked, and bolts 6 are used to connecting frames. Therefore, frames may be stacked for transportation, further cutting cost.

Example 2

As shown in FIG. 2, a schematic diagram of the present transporting apparatus, the apparatus is of a box. Put the generator horizontally in the box 4, which can be a rectangular cuboid steel box. The base of the frame has a plurality of connecting parts 22 designed to connect with the base of the generator 21. The standard holes 23 in the base of the generator are used to connect to the base of the box by bolting. Alternatively, holes 23 may be drilled in the base of the generator and the base of the frame, and use bolts for connection.

As shown in FIG. 3, a schematic diagram of fastening of the vertical shaft, using a supporting object in the steel box to support one end of the vertical shaft 11.

To avoid assembly the flanges on-site and reduce on-site workload, the upper flange and lower flange 15 may be fixed to the vertical shaft 11 before transportation.

In this way, the defect of loose tolerance for on-site flange-and-shaft assembly is solved, improving the wind turbine's stability and cutting on-site assembly time.

As shown in FIG. 4, to further facilitate the transportation, the width of one side of the box is slightly narrower or wider than that of the other side. A plurality of holes 5 are drilled at the connecting parts when frames are stacked, and bolts 6 are used to connecting boxes. Therefore, boxes may be stacked for transportation, further cutting cost.

Figure 5:
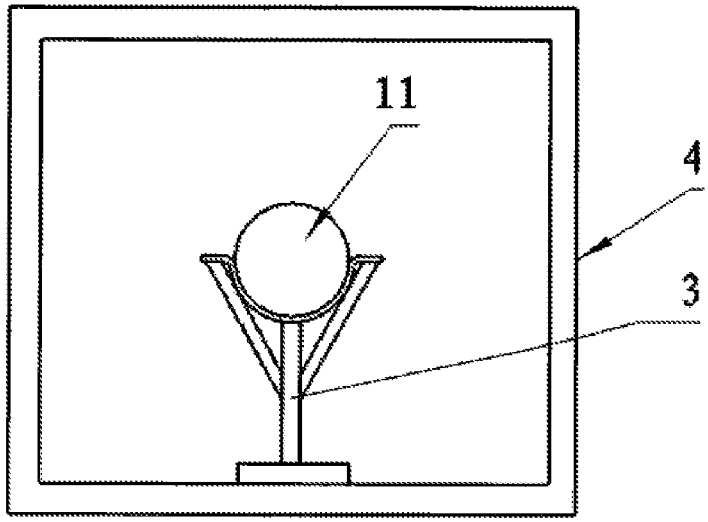
FIG. 5 is a schematic diagram of another way of fastening the vertical shaft.

As shown in FIG. 5, a schematic diagram of another way of fastening the vertical shaft. A V-shape supporting object 3 in the steel box 4 is used to support the vertical shaft.

While particular embodiments of the invention have been shown and described, it will be obvious to those skilled in the art that changes and modifications may be made without departing from the invention in its broader aspects, and therefore, the aim in the appended claims is to cover all such changes and modifications that fall within the true spirit and scope of the invention.

The invention claimed is:

1. A method for transporting a vertical axis wind turbine, comprising employing an apparatus comprising a box or a frame, the box or the frame having an undersurface and a length substantially corresponding to a length of a vertical shaft of the vertical axis wind turbine, and the undersurface having a plurality of connecting parts;

situating a generator of the vertical axis wind turbine horizontally in the box or the frame, the generator having a base, and the base having holes;

fixing the base of the generator to the connecting parts of the undersurface of the box or the frame through the holes in the base of the generator;

situating the vertical shaft horizontally in the box or frame, the vertical shaft having an upper end and a lower end, and the lower end of the vertical shaft being connected with the generator;

supporting the upper end of the vertical shaft by a supporting object, the supporting object being attached to the box or the frame; and transporting the vertical shaft and the generator of the vertical axis wind turbine fixed to the box or the frame of the apparatus.

2. The method of claim 1, further comprising stacking two or more of the apparatus vertically, and transporting the two or more of the vertically stacked apparatuses, wherein a width of one side of the box or the frame of one of the stacking apparatuses is slightly narrower or wider than that of the other stacking apparatus, and the stacking apparatuses are fixed and connected by bolts fitted into holes drilled on connecting parts on respective surfaces of adjacent apparatuses.

3. The method of claim 1, wherein the supporting object is made of steel.

4. The method of claim 3, wherein the supporting object is a steel tape, rope, or cord.

5. The method of claim 1, wherein the supporting object is located at about one third of the length of the vertical shaft from the upper end of the vertical shaft of the vertical axis wind turbine.

6. The method of claim 1, further comprising fixing an upper flange and a lower flange to the upper end and the lower end of the vertical shaft, respectively, before transporting the vertical axis wind turbine.

7. A method for transporting a vertical axis wind turbine, comprising employing an apparatus comprising a box or a frame, the box or the frame having an undersurface, and the undersurface having a plurality of connecting parts;

situating a generator of the vertical axis wind turbine horizontally in the box or the frame, the generator having a base, and the base having holes;

fixing the base of the generator to the connecting parts of the undersurface of the box or the frame through the holes in the base of the generator;

situating a vertical shaft of the vertical axis wind turbine horizontally in the box or the frame, the vertical shaft having an upper end and a lower end, and the lower end of the vertical shaft being connected with the generator;

supporting the vertical shaft by a supporting object, the supporting object being attached to the box or the frame; and transporting the vertical shaft and the generator of the vertical axis wind turbine fixed to the box or the frame of the apparatus.

8. The method of claim 7, wherein the supporting object is a steel tape, rope, or cord.

9. The method of claim 7, further comprising fixing an upper flange and a lower flange to the upper end and the lower end of the vertical shaft before transporting the vertical axis wind turbine.

* * * * *